US008342486B2

(12) United States Patent
Smith

(10) Patent No.: US 8,342,486 B2
(45) Date of Patent: Jan. 1, 2013

(54) DURABLE STEAM INJECTOR DEVICE

(76) Inventor: Robert S Smith, Seal Beach, CA (US)

( * ) Notice: Subject to any disclaimer, the term of this patent is extended or adjusted under 35 U.S.C. 154(b) by 340 days.

(21) Appl. No.: 12/852,667

(22) Filed: Aug. 9, 2010

(65) Prior Publication Data

US 2012/0032358 A1 Feb. 9, 2012

(51) Int. Cl.
*B01F 3/04* (2006.01)

(52) U.S. Cl. ..... 261/76; 261/79.2; 261/DIG. 10; 261/DIG. 76

(58) Field of Classification Search ..... 261/76, 261/79.2, DIG. 10, DIG. 76
See application file for complete search history.

(56) References Cited

U.S. PATENT DOCUMENTS 2,455,498 A 12/1948 Kern
3,652,061 A 3/1972 Chisholm
3,923,288 A 12/1975 King
3,984,504 A 10/1976 Pick
4,059,416 A 11/1977 Matovich
4,684,405 A 8/1987 Kolaska et al.
5,006,137 A 4/1991 Agrawal et al.
5,863,587 A * 1/1999 Badertscher et al. ..... 426/511
6,082,713 A 7/2000 King
6,488,402 B1 12/2002 King et al.

* cited by examiner

*Primary Examiner* — Robert A Hopkins

(57) ABSTRACT

A device for the injection and mixing of steam into a fluid stream. The device is intended to be used in a substantially cylindrically-shaped primary conduit having a longitudinal axis and circular cross-section for carrying the fluid stream. The primary conduit is provided with an inlet for accepting the fluid stream and an outlet for discharging the fluid stream along the longitudinal axis. A secondary conduit is joined to the primary conduit for discharging steam within the fluid stream along the longitudinal axis. A biscuit element is provided of sintered tungsten having upstream and downstream circular faces sized to fit within the primary conduit along its interior wall having a geometric center coincident with the longitudinal axis and having a plurality of openings, each having a longitudinal axis parallel to the longitudinal axis of the primary conduit. Each opening is provided with a mixing element that induces a rotational angular velocity to the fluid stream passing therethrough. Conically-shaped features extend from the circular faces and are centered along the longitudinal axis at the geometric centers thereof.

7 Claims, 1 Drawing Sheet

DURABLE STEAM INJECTOR DEVICE

TECHNICAL FIELD

The present invention is directed to a highly efficient steam injector, a steam injection heater for the heating of liquids moving within a conduit. For example, waste effluent from mining operations including mining tailings are processed in order to remove solvent from its aqueous carrier liquid. Separation of this effluent stream into its component parts is facilitated by heating. An excellent way to do so is through the use of a steam injector device such as that of the present invention.

BACKGROUND OF THE INVENTION

Steam injection has been a unit operation carried out by chemical engineers in processing facilities for as long as chemical engineering has been a science. For example, a typical steam injection water heater was disclosed in U.S. Pat. No. 2,455,498. Subsequently, U.S. Pat. No. 3,984,504 dealt with the fabrication of a rather complex device used to eliminate water hammer which has characterized steam injection systems in the past. It was recognized that such heaters worked satisfactorily at relatively low steam pressure such as at pressures below 300 psi. At high steam pressures, however, water hammer develops due to the sudden collapse of relatively large steam bubbles which are created at high pressures as it condenses within the water.

Steam injection has also been viewed as a preferred expedient in the heat transfer from a first fluid to a moving steam of a liquid commonly employed in food processing. Liquid food products often times must be heated for sterilization and other purposes in an environment which maintains the integrity of the food product free of contamination from the heat source.

Direct steam injection has long been recognized as an exceedingly efficient technique for heating liquids. As steam is injected directly into a liquid, one can realize almost 100 percent of the BTU's in the steam which are absorbed directly into the liquid. Unlike indirect heating by means of, for example, a heat exchanger, there is no condensate retaining unused sensible heat. Because of this high heat-transferability, direct steam injection can save a great deal in energy costs.

Direct steam injection systems offer other benefits as well when compared to heat exchangers and comparable indirect heating systems. A direct steam injection system can provide very accurate temperature control within several degrees Fahrenheit and are efficient in that scale buildup does not become an issue. Systems of this nature also tend to be more compact then comparable heat exchange devices.

There are four basic types of direct steam injection systems, namely, the sparger, the mixing tee, the Venturi and the modulating injection system. The sparger is the simplest system in that it generally consists of nothing more than a perforated pipe discharging steam in a vented storage tank. However, these systems are not without their disadvantages. For example, they must be operated at a set and constant flow rate to prevent the hammering effect observed in steam/water systems. This is the result of operating at steam and water pressures which are at or near equilibrium.

Mixings tees comprise nothing more than steam and water-lines which join a common conduit. Because separate lines are used for each fluid, capital equipment tends to be expensive and inconvenient to install.

Venturi systems are generally more acceptable than those previously discussed, but should be operated under conditions of constant steam pressure, inlet water pressure and outflow demand. If they do not, hammering effect can again be observed as the steam and inlet water pressures approach an equilibrium condition. In addition, changes in these variables can result in varying outlet temperatures which may not be desired.

Prior attempts have even been made to employ static mixers for direct steam injection into a fluid stream. However, as in the other prior approaches, the results have proven spotty with instability and lack of control problems being manifest.

The owner of the present application is also the owner of other patents in the field of steam injection. For example, see U.S. Pat. Nos. 5,006,137 and 6,082,713. Although applicant has previously suggested the use of static mixing elements to facilitate the injection of steam within a fluid stream, many such fluid streams, such as those effluent streams from mining operations alluded to above can cause erosion of critical elements. Although static mixing elements, by their very definition, have no moving parts and are thus relatively inexpensive to install and service, when servicing is required, the cost and inconvenience of doing so can be significant as processing lines must be shut down or diverted and various pipelines disconnected in order to gain access to their interiors.

It is thus an object of the present invention to provide a static mixing element in the form of a modular injection system for the introduction of steam to a fluid which is considerably more resistant to wear than comparable prior devices.

It is yet a further object of the present invention to provide a modular injection system for the introduction of steam into a fluid which is capable of being removed for servicing and the like more conveniently than comparable devices of the prior art.

These and further objects will be more readily apparent when considering the following disclosure and appended claims.

SUMMARY OF THE INVENTION

A device for the injection and mixing of steam into a fluid stream. The device is intended to be used in a substantially cylindrically-shaped primary conduit having a longitudinal axis and circular cross-section for carrying the fluid stream. The primary conduit is provided with an inlet for accepting the fluid stream and an outlet for discharging the fluid stream along the longitudinal axis. A secondary conduit is joined to the primary conduit for discharging steam within the fluid stream along the longitudinal axis. A biscuit element is provided of sintered tungsten having upstream and downstream circular faces sized to fit against the primary conduit along its interior wall having a geometric center coincident with the longitudinal axis and having a plurality of openings, each having a longitudinal axis parallel to the longitudinal axis of the primary conduit. Each opening is provided with a mixing element that induces a rotational angular velocity to the fluid stream passing therethrough. Conically-shaped features extend from the circular faces and are centered along the longitudinal axis at the geometric centers thereof.

DETAILED DESCRIPTION OF THE INVENTION

Figure 1:
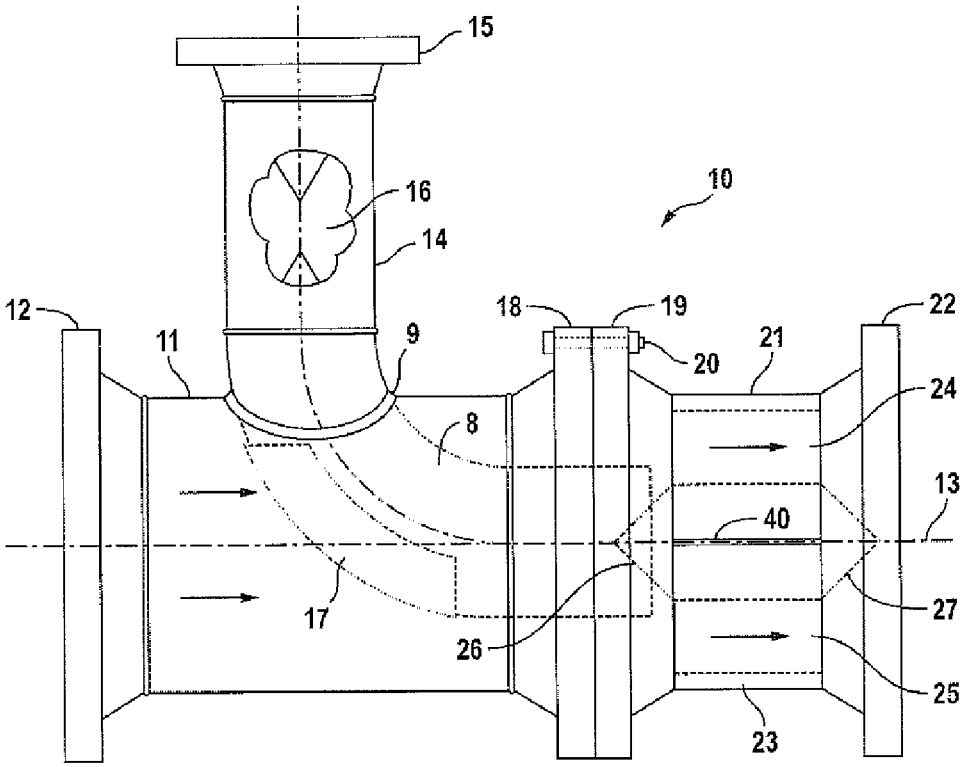
FIG. 1 is a side view, partly in cut away depicting the present invention.

Novel features which are characteristic of the invention, as to organization and method of operation, together with further objects and advantages thereof will be better understood from the following description considered in connection with the accompanying drawings, in which preferred embodiments in the invention are illustrated by way of example. It is to be expressly understood, however, that the drawings are for the illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Turning first to FIG. 1, device 10 of the present invention is shown for the injection and mixing of steam into a fluid stream. The device comprises substantially cylindrically-shaped primary conduit 11 receiving the fluid stream (not shown) past flange 12. Cylindrically-shaped primary conduit 11 has a substantially circular cross-section and longitudinal axis 13 designed for carrying the fluid stream. As depicted in FIG. 1, primary conduit 11 has an inlet for accepting the fluid stream, again, at flange 12 and an outlet for discharging the fluid stream at flange 22.

Secondary conduit 14 is joined to primary conduit 11 preferably by passing through sidewall 9 of primary conduit 11 as shown. Secondary conduit 14 passes perpendicular to sidewall 9 and transitions to elbow portion 8 for discharging steam carried by secondary conduit 14 parallel to the fluid stream passing within the primary conduit along longitudinal axis 13. To assist in reducing the corrosive effects that fluid passing within primary conduit 11 has on secondary conduit 14, barrier plate 17 is placed as shown in a position where the fluid flow would impact the secondary conduit.

As a preferred embodiment, mixing element 16 is placed within secondary conduit 14 which is intended to impact the flow of steam passing therethrough. Virtually any mixing element 16 can be employed while remaining within the scope of the present invention. Such a mixing element is employed to cause steam passing within secondary conduit 14 to emanate therefrom in the form of a rotating cone. Ideally, the mixing element disclosed in U.S. Pat. No. 3,652,061, the disclosure which is incorporated by reference, can be employed.

Again referring to FIG. 1, biscuit section 21 is shown as an extension of primary conduit 11 made by connecting flanges 18 and 19 through the use of bolts or other securing members 20. Contained within biscuit section 21 is biscuit element 23 facing upstream and downstream as shown and sized to fit within primary conduit 11.

Biscuit element 23 is configured with a plurality of openings 24, 25, etc. In the example shown in the figures, a hexagonal array of six such openings are shown being equidistant about longitudinal axis 13.

Figure 2:
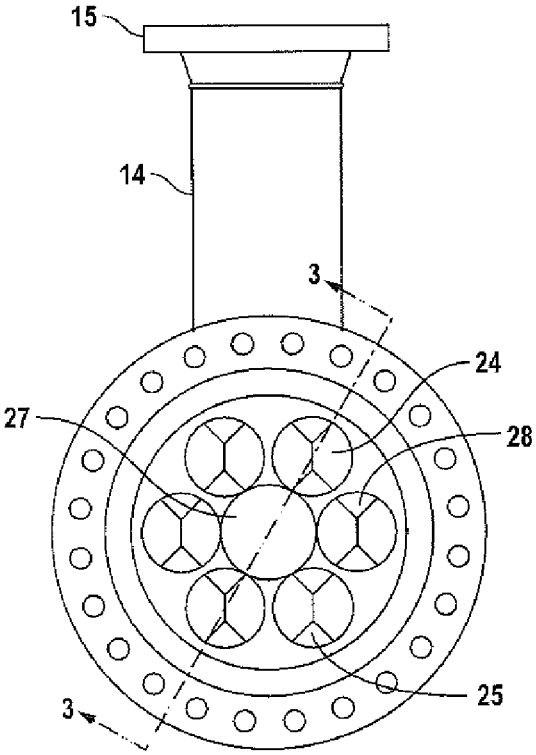
FIG. 2 is an end view of the present invention.

It is intended that each opening 24, 25, etc be fitted with a mixing element that would induce a rotational angular velocity to a fluid stream passing therethrough. As a preferred embodiment, mixing elements 28 (FIG. 2) and 38 (FIG. 3) induce the same rotational sign to fluids passing therethrough in order to maximize mixing. Ideally, these mixing elements can be those disclosed in the present assignee's prior U.S. Pat. No. 3,923,288. Such mixing elements include a central flat rectangular portion, the plane of which is intended to generally align with the fluid inlet along its longitudinal axis which substantially parallels longitudinal axis 13 of primary conduit 11. First and second ears emanate from this centrally located flat portion and are rounded or otherwise configured at their outside peripheries for a general fit to the sidewalls of the openings in which they are placed. As noted in the '288 patent, the disclosure which is incorporated by reference, these mixing elements can be formed from a single flat sheet by a punch press, for example. However, the invention is not intended to be limited to any particular fabrication nor is the invention limited to providing those elements of the '288 patent as other mixing elements which perform the same function can be employed.

Figure 3:
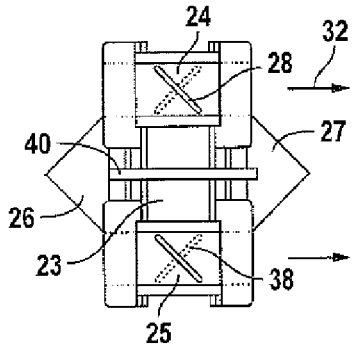
FIG. 3 is a partial crossectional view of the present invention taken along line 3-3 of FIG. 2.

In order to optimize the fluid dynamics of mixing, conically-shaped features 26 and 27 are applied to the circular faces of biscuit element 23 best seen by reference to FIG. 3. As it is the intent of the present invention to provide a mixing device which is not only durable in service but also contains parts which can be readily removed for cleaning and replacement, it is proposed, as a preferred embodiment that conically-shaped features 26 and 27 be removabley attached to biscuit element 23 through the use of rod 40 passing therethrough. The ends of rod 40 can be threaded to mate with threaded receiving ports within conically-shaped features 26 and 27 although other methods of attachment can be employed while remaining within the spirit and scope of the present invention. In doing so, connecting rod 40 and thus the conically-shaped features 26 and 27, themselves, are centered about longitudinal axis 13 as best seen by reference to FIG. 1.

It is also proposed as a preferred embodiment that all of the mixing elements 28, 38, etc. be removable from their respective plurality of openings 24, 25, etc. by pulling the mixing elements from their respective openings such as suggested by arrows 32 (FIG. 3). Thus, these mixing elements can be removed for cleaning and replacement as needed. As is quite apparent, the entire biscuit section 21 can be removed from the remainder of device 10 by simply detaching flanges 18 and 19 by the removal of fasteners 20. Thus, the biscuit element itself as well as its mixing elements and conically-shaped features can be readily accessed for replacement or cleaning when needed.

To enhance the durability of the present invention, as a preferred embodiment, biscuit element 23 is composed of sintered tungsten. This can be created by "cementing" very hard tungsten monocarbide grains in a binder matrix of tough cobalt metal by liquid phase sintering. Alternatively, sintered tungsten can be produced according to the teachings of U.S. Pat. No. 4,684,405, the disclosure which is incorporated by reference herein. According to the patented method, metal particles composed of from 75 to 95 percent by weight of a composition containing at least 70 percent by weight of tungsten carbide is combined with 5 to 25 percent by weight of a binder metal composition, the binder metal composition being 5 to 15 percent by weight of chromium and 85 to 95 percent by weight of nickel. The metal particles are pressed into a body and sintered at high temperatures and under vacuum in the presence of a noble gas together with hydrogen gas to form a sintered body. The block of sintered metal can then be machined into biscuit element 23.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, and changes in equivalence will readily occur to those skilled in the art and may be employed as suitable, without departing from the true spirit and scope of the invention. Such changes might involve alternative materials, components, structural arrangements, sizes, shapes, forms, functions, operational features or the like. Therefore, the present description and illustrations should not be considered as limiting the scope of the invention, which is defined by the appended claims.

What is claimed is:

1. In a device for the injection and mixing of steam into a fluid stream, said device comprising a substantially cylindrically-shaped primary conduit having a longitudinal axis and a substantially circular cross-section for carrying said fluid stream, said primary conduit being provided with an inlet for accepting said fluid stream and an outlet for discharging said fluid stream along said longitudinal axis, and a secondary conduit joined to said primary conduit for discharging steam within said fluid stream along said longitudinal axis, the improvement comprising a biscuit element of sintered tungsten having upstream and downstream circular faces of a diameter approximately that of said primary conduit's interior wall and having a geometric center coincident with said longitudinal axis and having a plurality of openings through said biscuit each having a longitudinal axis substantially parallel to the longitudinal axis of said primary conduit and said openings having located therein, mixing elements that induce a rotational angular velocity to said fluid stream passing therethrough and conically-shaped features extending from said circular faces and centered along said longitudinal axis at the geometric centers thereof.

2. The device of claim 1 wherein all of said mixing elements induce the same rotational sign to the fluids passing through said openings.

3. The device of claim 1 wherein each of said mixing elements are removable from said openings for cleaning and replacement.

4. The device of claim 1 wherein said secondary conduit passes through a side wall of said primary conduit approximately perpendicular thereto transitioning to an elbow portion for discharging steam parallel to the fluid stream passing within said primary conduit.

5. The device of claim 4 wherein said secondary conduit further comprises a barrier plate positioned at said elbow where said fluid flow impacts said secondary conduit.

6. The device of claim 1 wherein a supplemental mixing element is further fit within said secondary conduit upstream of said biscuit element.

7. The device of claim 1 wherein said biscuit element is positioned within a biscuit element housing, said biscuit element housing having a flange to removably connect the housing to the outlet of said primary conduit.

* * * * *